US005623733A

United States Patent [19]

Kurimoto et al.

[11] Patent Number: 5,623,733

[45] Date of Patent: Apr. 29, 1997

[54] MOISTURE RETAINING FACE MASK

[76] Inventors: Humi Kurimoto, 3-2, Saginomiya 3-chome; Yuhko Takahashi, 28-14-102, Saginomiya 1-chome, both of Nakano-ku, Tokyo, Japan

[21] Appl. No.: 365,011

[22] Filed: Dec. 28, 1994

[30] Foreign Application Priority Data

Dec. 29, 1993 [JP] Japan ..... 5-222353

[51] Int. Cl.[6] ..... A42B 1/00

[52] U.S. Cl. ..... 2/206; 2/9; 2/171.2; 2/174; 132/319

[58] Field of Search ..... 2/9, 171.2, 173, 2/174, 206, 424; 132/319, 333; 607/109, 140

[56] References Cited

U.S. PATENT DOCUMENTS 3,768,100 10/1973 Colman et al. ..... 2/9

4,259,748 4/1981 Miller ..... 2/9

4,941,211 7/1990 Blutstein ..... 2/206

*Primary Examiner*—Diana Biefeld

*Attorney, Agent, or Firm*—Wenderoth, Lind & Ponack

[57] ABSTRACT

A moisture retaining face mask designed to avoid drying and lowering of the temperature of the skin prevents the skin from becoming rough by synergistic effect obtained when the mask is used in combination with cosmetics. Basically, the mask has a mask body composed of an outer mask made of a material that is highly air permeable, hygroscopic and heat retentive. An inner mask is made of a material that is heat retentive and hygroscopic. The inner mask is in close contact with the reverse side of the outer mask and separately joined thereto through hooks or other appropriate members. The outer mask has a face covering portion which is sewn to form three dimensions in conformity with a user's facial configuration. The mask is provided with openings at respective positions corresponding to a user's eyes and mouth, and a belt-shaped neck covering portion which is integrally sewn to a lower edge of the face covering portion.

7 Claims, 7 Drawing Sheets

Fig. 8
Fig. 7
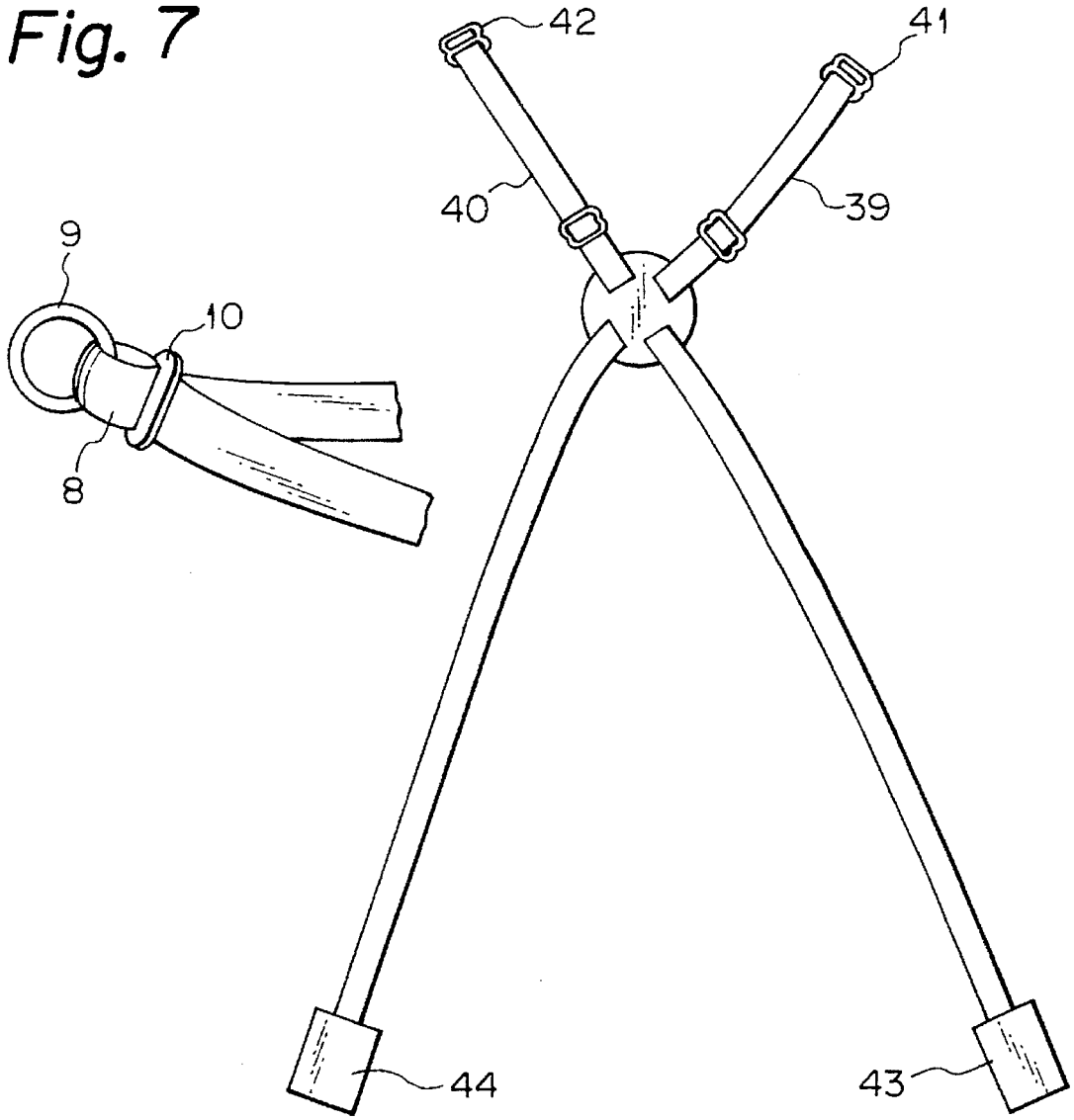
Fig. 9
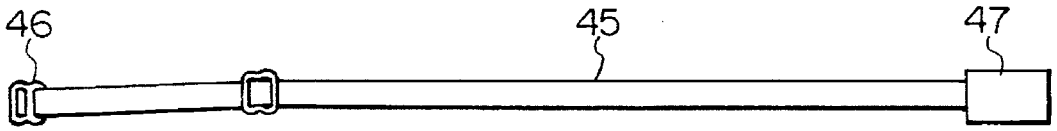

MOISTURE RETAINING FACE MASK

BACKGROUND OF THE INVENTION

1. Field of the Invention

The present invention relates to a moisture retaining face mask designed to be worn while the user is asleep at night.

2. Description of the Background Art

Drying is considered to be one factor which accelerates aging of the skin. Recently, with the spread of air conditioning systems, our living environment has become one in which the skin is more likely to dry. Particularly, lowering of the temperature and humidity in a room at night impairs circulation of the blood and inactivates the metabolism. Consequently, the skin ages and becomes rough and finely wrinkled, thus losing its youthful appearance.

It is known that "beautiful skin is made at night", and it is said that oil, moisture and a stable temperature are necessary for making beautiful skin at night.

It has heretofore been proposed to prevent aging of the skin by preventing it from drying. For example, it has been proved by experience that, when one's hands have become rough, if gloves are worn in bed with hand cream being rubbed into the rough skin and drying of the skin is prevented at night remoistening takes place. To prevent aging of the skin as well as drying, it is important to protect the skin from the cold. Stress of the facial muscles may cause rough skin, but it is known that stress tends not to build up in the facial muscles under moderately warm conditions. Therefore, an effective way of preventing the skin from becoming rough is to warm up the skin to such an extent that one feels comfortable.

Nowadays, all cosmetics have improved quality, and a great variety of cosmetics containing a moisture retention component for preventing development of wrinkles due to drying of the skin have appeared on the market in recent years. The present invention aims at avoiding drying and lowering of the skin temperature in order to make the best use of cosmetics. The invention thus aims at a synergistic effect obtained by being combined with cosmetics.

SUMMARY OF THE INVENTION

In view of the above-described circumstances, an object of the present invention is to provide a moisture retaining face mask for preventing drying and lowering in of the skin temperature by utilizing the physiological activity of the skin, which metabolises even at night.

To attain the above-described object, the present invention provides a moisture retaining face mask including a mask body for covering the user's face, which has openings formed at respective positions corresponding to the user's eyes and mouth, and a securing device that enables the mask body to be held in close contact with the user's face.

The mask body may include a face covering portion for covering the user's face, and a neck covering portion for covering the user's chin and neck.

The mask body may include an outer mask made of a material having excellent air permeability, hygroscopicity and heat retaining properties, and an inner mask made of a material having excellent hygroscopicity.

The outer and inner masks may be detachable from each other.

The outer and inner masks may be laid one on top of the other and sewn together.

In addition, the present invention provides a moisture retaining face mask including a mask body including an outer mask made of a material excellent in air permeability, hygroscopicity and heat retaining properties, and an inner mask made of a material having excellent hygroscopicity.

The inner mask is brought into close contact with the reverse side of the outer mask and separably joined thereto through appropriate members, for example, hooks.

The outer mask includes a face covering portion which sewn to form three dimensions in conformity with the facial configuration and which is provided with openings at respective positions corresponding to the user's eyes and mouth, and a belt-shaped neck covering portion which is integrally sewn to the lower edge of the face covering portion.

The outer mask has a first tubular elastic cord inserting or housing portion provided along the peripheral edge thereof except along a lower peripheral edge end of the face covering portion. The elastic cord inserting portion has an opening at the top of the face covering portion. A first fastening elastic cord is inserted into the first elastic cord inserting portion through the opening and fixed at both ends thereof in the elastic cord inserting portion. A second tubular elastic cord inserting or housing portion is provided along the lower edge of the face covering portion. The second elastic cord inserting portion has an opening at the chin of the face covering portion. A second fastening elastic cord is inserted into the second elastic cord inserting portion through the opening and fixed at both ends thereof in the elastic cord inserting portion. A third tubular elastic cord inserting or housing portion is provided along the upper edge of the neck covering portion. The third elastic cord inserting portion has an opening in the center of the reverse side of the neck covering portion. A third fastening elastic cord is inserted into the third elastic cord inserting portion and partially drawn out from the opening provided in the center of the reverse side of the neck covering portion.

The inner mask includes a face covering portion which is sewn to form three dimensions in conformity with the facial configuration and which is provided with openings at respective positions corresponding to a user's eyes and mouth, and a belt-shaped neck covering portion which is integrally sewn to the lower edge of the face covering portion.

The inner mask has an elastic cord outlet opening in the upper end of the center of the neck covering portion thereof for drawing out a part of the third fastening elastic cord of the outer mask.

The outer mask has a Hook-and-Loop fastener fixed to the obverse side of either of the left and right sides of the face covering portion thereof, and Hook-and-Loop fasteners fixed to the outer side of the neck covering portion thereof at respective positions corresponding to the nape of a user's neck. The outer mask further has joint securing Hook-and-Loop fasteners fixed to the neck covering portion such that one of the Hook-and-Loop fasteners is disposed on the obverse side of either of the left and right end portions of the neck covering portion, and the other Hook-and-Loop fastener is disposed on the reverse side of the other of the left and right end portions.

The inner mask has a joint securing Hook-and-Loop fastener fixed to the reverse side of one lateral end portion thereof.

The moisture retaining face mask further includes a pair of tapes crossed in an X shape. One end of each tape is connectable to the top of the face covering portion of the outer mask. The two tapes have Hook-and-Loop fasteners respectively fixed to the other ends thereof so that these Hook-and-Loop fastener are stuck to the respective Hook-and-Loop fasteners which are fixed to the neck covering portion of the outer mask at the positions corresponding to the nape of a user's neck.

Another tape is connectable at one end thereof to either of the left and right sides of the face covering portion of the outer mask. The tape has a Hook-and-Loop fastener fixed to the other end thereof so that the Hook-and-Loop fastener is stuck to the Hook-and-Loop fastener fixed to the side of the face covering portion of the outer mask.

In addition, the present invention provides a moisture retaining face mask including a mask body having a face covering portion which is three-dimensionally sewn in conformity to a facial configuration and which is provided with openings at respective positions corresponding to the user's eyes and mouth, and a belt-shaped neck covering portion which is integrally sewn to the lower edge of the face covering portion. The face and neck covering portions are made of a double-layered material composed of a material excellent in heat retaining properties and hygroscopicity and another material having excellent air permeability and hygroscopicity. The two different kinds of material are laid one on top of the other and sewn together so that the latter material, which is excellent in air permeability and hygroscopicity, constitutes the inner side of the mask body. A first tubular elastic cord inserting or housing portion is provided along the peripheral edge of the mask body except along a lower peripheral edge of the face covering portion. The elastic cord inserting portion has an opening at the top of the face covering portion. A first fastening elastic cord is inserted into the first elastic cord inserting portion from the opening and fixed at both ends thereof in the elastic cord inserting portion. A second tubular elastic cord inserting or housing portion is provided along the upper edge of the neck covering portion. The second elastic cord inserting portion has an opening at the chin of the face covering portion. A second fastening elastic cord is inserted into the second elastic cord inserting portion from the opening and fixed at both ends thereof in the elastic cord inserting portion.

The mask body has a Hook-and-Loop fastener fixed to the obverse side of either of the left and right sides of the face covering portion, and Hook-and-Loop fasteners fixed to the outer side of the neck covering portion at respective positions corresponding to the nape of the neck. The mask body further has joint securing Hook-and-Loop fasteners fixed to the neck covering portion such that one of the Hook-and-Loop fasteners is disposed on the obverse side of either of the left and right end portions of the neck covering portion, and the other Hook-and-Loop fastener is disposed on the reverse side of the other of the left and right end portions.

The moisture retaining face mask further includes a pair of tapes crossed in an X shape. One end of each tape is connectable to the top of the face covering portion. The two tapes have Hook-and-Loop fasteners respectively fixed to the other ends thereof so that these Hook-and-Loop fasteners are stuck to the respective Hook-and-Loop fasteners which are fixed to the neck covering portion at positions corresponding to the nape of a user's neck.

Another tape is connectable at one end thereof to either of the left and right sides of the face covering portion. The tape has a Hook-and-Loop fastener fixed to the other end thereof so that the Hook-and-Loop fastener is stuck to the Hook-and-Loop fastener fixed to the side of the face covering portion.

In the above-described moisture retaining face mask, the face and neck covering portions may be formed by cutting a single piece of cloth into a pair of left and right halves with openings provided therein at respective positions corresponding to the user's eyes and mouth, and sewing them to each other along the center line of the face so that the resulting mask body conforms to a facial configuration.

In the above-described arrangements, the outer mask or the mask body may be produced by hand knitting, machine knitting, or sewing.

According to the present invention, the user puts the moisture retaining face mask on his/her face so that the eyes and mouth of the mask body coincide with his/her eyes and mouth, and then holds the mask in close contact with his/her face by using the securing device. By wearing the moisture retaining face mask in this way, the user's face and neck are protected and thus kept warm under moisture retaining conditions.

More specifically, the moisture retaining face mask of the present invention is worn as follows:

First, the user puts the face covering portion on his/her face, and joins together the end portions of the neck covering portion at the nape of his/her neck. Then, the two tapes crossed in an X-shape, which are connected at one end thereof to the top of the face covering portion, are fixed at the other ends thereof to the nape side of the neck covering portion. Next, the tape, which is connected at one end thereof to either of the left and right sides of the face covering portion, is wound horizontally on the user's head and fixed at the other end thereof to the other side of the face covering portion. Then, the fastening elastic cord, which projects from the top of the face covering portion, is pulled to narrow and adjust the peripheral edge portion of the face covering portion in conformity to the size of the user's face. Finally, the fastening elastic cord provided at the border between the face and neck covering portions is pulled to narrow the portion of the mask below the user's chin. Thus, the user's face is completely covered with the face covering portion, and the user's neck, including the nape, is also completely covered with the neck covering portion. Since the mask is fastened tight by the elastic cords and the tapes, both the face and neck covering portions are brought into close contact with the skin, thereby enabling the user's face and neck to be kept warm. At the same time, the skin is prevented from drying.

BRIEF DESCRIPTION OF THE DRAWINGS

The above and other objects, features and advantages of the present invention will become more apparent from the following description of preferred embodiments thereof, taken in conjunction with the accompanying drawings, in which like reference numerals denote like elements, and of which:

FIG. 7 is a fragmentary enlarged view of a fastening elastic cord used in the present invention;

FIG. 8 is a plan view of a pair of tapes for stably holding the moisture retaining face mask of the present invention with respect to the vertical direction;

FIG. 9 is a plan view of a tape for stably holding the moisture retaining face mask of the present invention with respect to the horizontal direction;

DESCRIPTION OF THE PREFERRED EMBODIMENTS

Embodiments of the present invention will be described below in detail with reference to the accompanying drawings.

Figure 1:
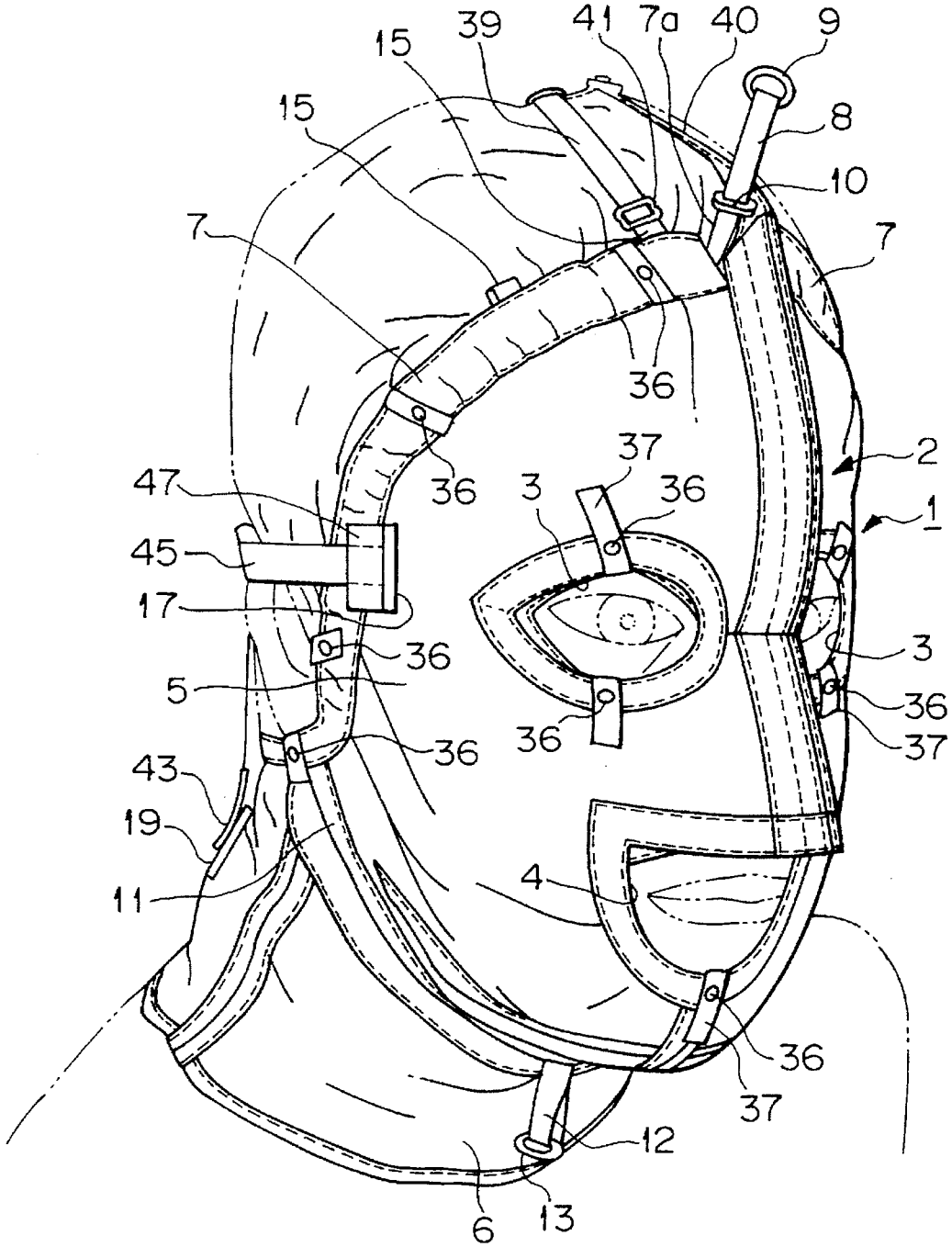
FIG. 1 is a perspective view of a first embodiment of the present invention in use as viewed diagonally to the front of it.
Figure 2:
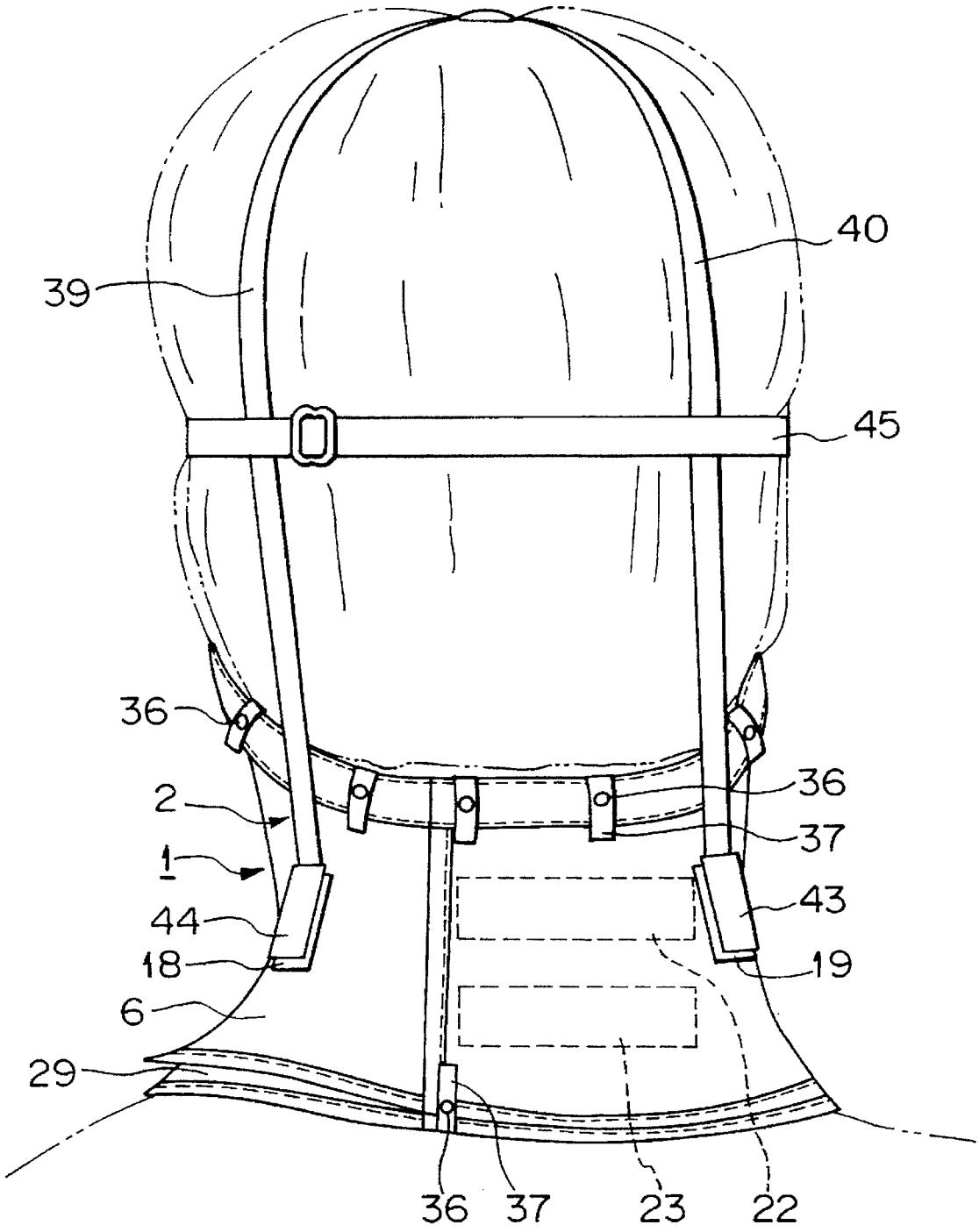
FIG. 2 is a rear view of the first embodiment of the present invention which is in use.

Referring to FIGS. 1 and 2, a first embodiment of the moisture retaining face mask according to the present invention has a mask body 1. The mask body 1 has an outer mask 2 made of a material excellent in air permeability, hygroscopicity and heat retaining properties, e.g., wool knit or flannel, and an inner mask 29 made of a material of excellent hygroscopicity, e.g., cotton flannel. The materials of the outer and inner masks 2 and 29 are not necessarily limited to those mentioned above. For use in spring and autumn, the moisture retaining face mask may use a material which is excellent in air permeability and hygroscopicity, e.g., light-gage cotton (cotton muslin), cotton gauze, etc.; for use in winter, the moisture retaining face mask may use a material having excellent heat retaining properties in addition to air permeability and hygroscopicity, e.g., heavy-gage cotton (flannel). The outer and inner masks 2 and 29 are produced by sewing materials selected from those mentioned above. The outer mask 2 may be produced by hand knitting, machine knitting, or sewing. In this embodiment, the outer and inner masks 2 and 29 are brought into close contact with each other and detachably joined together. It should be noted that the joined condition of the outer and inner masks 2 and 29 is maintained by using hooks, safety pins, a fastener which is known as "magic tape", or other appropriate fastening members. Although the outer mask 2 in this embodiment is made of a cloth, e.g., flannel, it may be arranged such that two or three cloths are laid one on top of another and joined together with hooks or other fastening members, thereby enabling the thickness of the outer mask 2 to be appropriately changed according to seasons.

Figure 3:
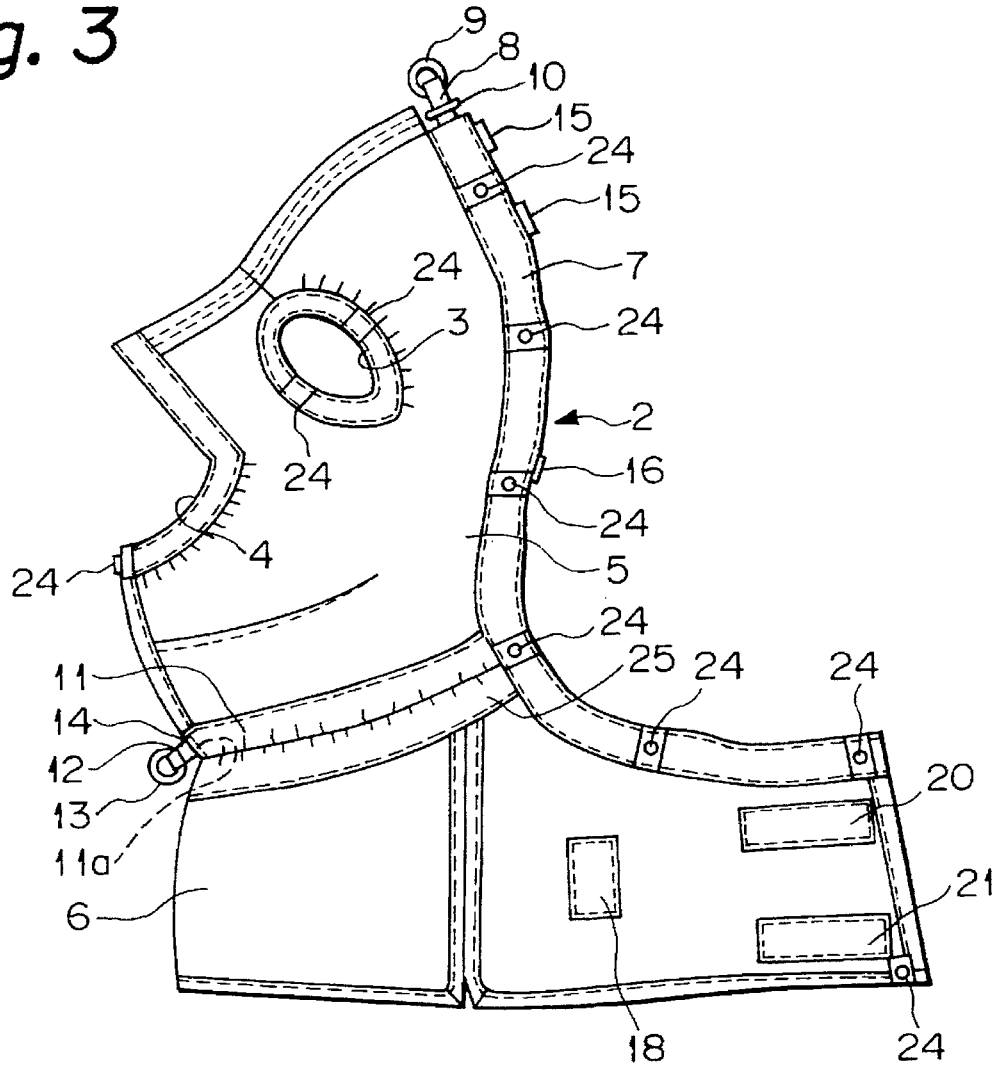
FIG. 3 is a side view of an outer mask in the first embodiment of the present invention as viewed from the left-hand side thereof.
Figure 4:
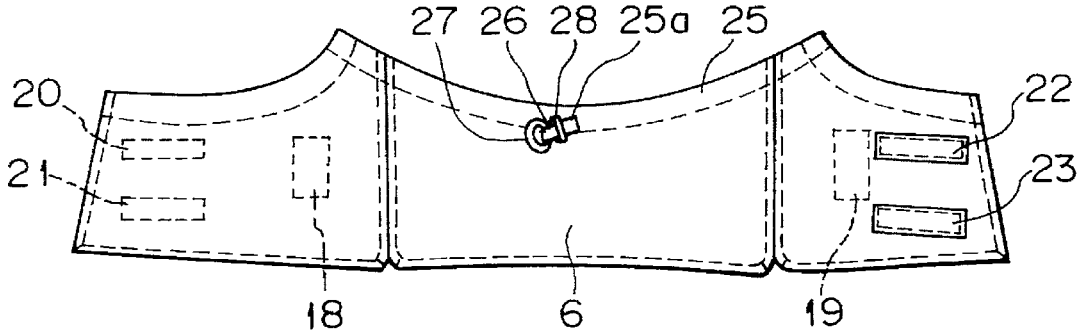
FIG. 4 is a rear view of a neck covering portion of the outer mask in the first embodiment of the present invention which is in an open state.

Referring to FIGS. 3 and 4 in combination with FIGS. 1 and 2, the outer mask 2 is composed of a face covering portion 5 which is three-dimensionally formed by sewing in conformity to the facial configuration and which is provided with openings 3 and 4 at respective positions corresponding to the eyes and the mouth, and a belt-shaped neck covering portion 6 which is integrally sewn to the lower edge of the face covering portion 5. The face covering portion 5 is stuffed with padding cloth (not shown) at positions corresponding to the forehead and the ridge of the nose. Both the face covering portion 5 and the neck covering portion 6 are sewn with all the seamed portions turned up to the obverse side so that the seamed portions will not come in direct contact with the user's skin.

The outer mask 2 has a tubular elastic cord or housing inserting portion 7 provided along the peripheral edge thereof except along the lower end of the face covering portion 5. The elastic cord inserting portion 7 has an opening 7*a* provided at the top of the face covering portion 5. A fastening elastic cord 8 is folded into two, and the two halves of the folded elastic cord 8 are inserted into the left and right halves, respectively, of the tubular elastic cord inserting portion 7. The ends of the two halves of the elastic cord 8 inserted are connected to the inner ends, respectively, of the tubular elastic cord inserting portion 7. The central portion of the fastening elastic cord 8 is left projecting from the opening 7*a* and provided with a ring 9 and a fitting member 10 for adjusting the fastening condition of the elastic cord 8 (see FIG. 7).

The outer mask 2 further has a tubular elastic cord inserting portion 11 provided along the lower edge of the face covering portion 5. The tubular elastic cord inserting portion 11 has an opening 11*a* at the chin of the face covering portion 5. A fastening elastic cord 12 is folded into two, and the two halves of the folded elastic cord 12 are inserted into the left and right halves, respectively, of the tubular elastic cord inserting portion 11. The ends of the two halves of the elastic cord 12 inserted are connected to the inner ends, respectively, of the tubular elastic cord inserting portion 11. The central portion of the fastening elastic cord 12 is left projecting from the opening 11*a* and provided with a ring 13 and a fitting member 14 for adjusting the fastening condition of the elastic cord 12.

Ring-shaped engagement portions 15 are provided on the top of the face covering portion 5. Another ring-shaped engagement portion 16 is provided on either of the left and right sides of the face covering portion 5. A Hook-and-Loop fastener 17 is attached to the side of the face covering portion 5 which is opposite to the side thereof where the ring-shaped engagement portion 16 is provided.

Hook-and-Loop fasteners 18 and 19 are attached to the neck covering portion 6 at respective positions closer to the nape of the neck. Hook-and-Loop fasteners 20, 21, 22 and 23 are attached to the neck covering portion 6 such that the Hook-and-Loop fasteners 20 and 21 are disposed on the obverse side of the left end portion of the neck covering portion 6, while the Hook-and-Loop fasteners 22 and 23 are disposed on the reverse side of the right end portion of the neck covering portion 6. Female hooks 24 are attached to the peripheral edges of the face and neck covering portions 5 and 6 and to the edges of the eye and mouth openings 3 and 4 of the face covering portion 5.

A tubular elastic cord inserting portion 25 is provided along the upper edge of the neck covering portion 6. The tubular elastic cord inserting portion 25 has an opening 25*a* which is open to the reverse side of the neck covering portion 6. An elastic cord 26 is folded into two, and the two halves of the folded elastic cord 26 are inserted into the left and right halves, respectively, of the tubular elastic cord inserting portion 25. The ends of the two halves of the elastic cord 26 inserted are connected to the inner ends, respectively, of the tubular elastic cord inserting portion 25. The central portion of the elastic cord 26 is left projecting from the opening 25*a* and provided with a ring 27 and a fitting member 28 for adjusting the fastening condition of the elastic cord 26.

Figure 5:
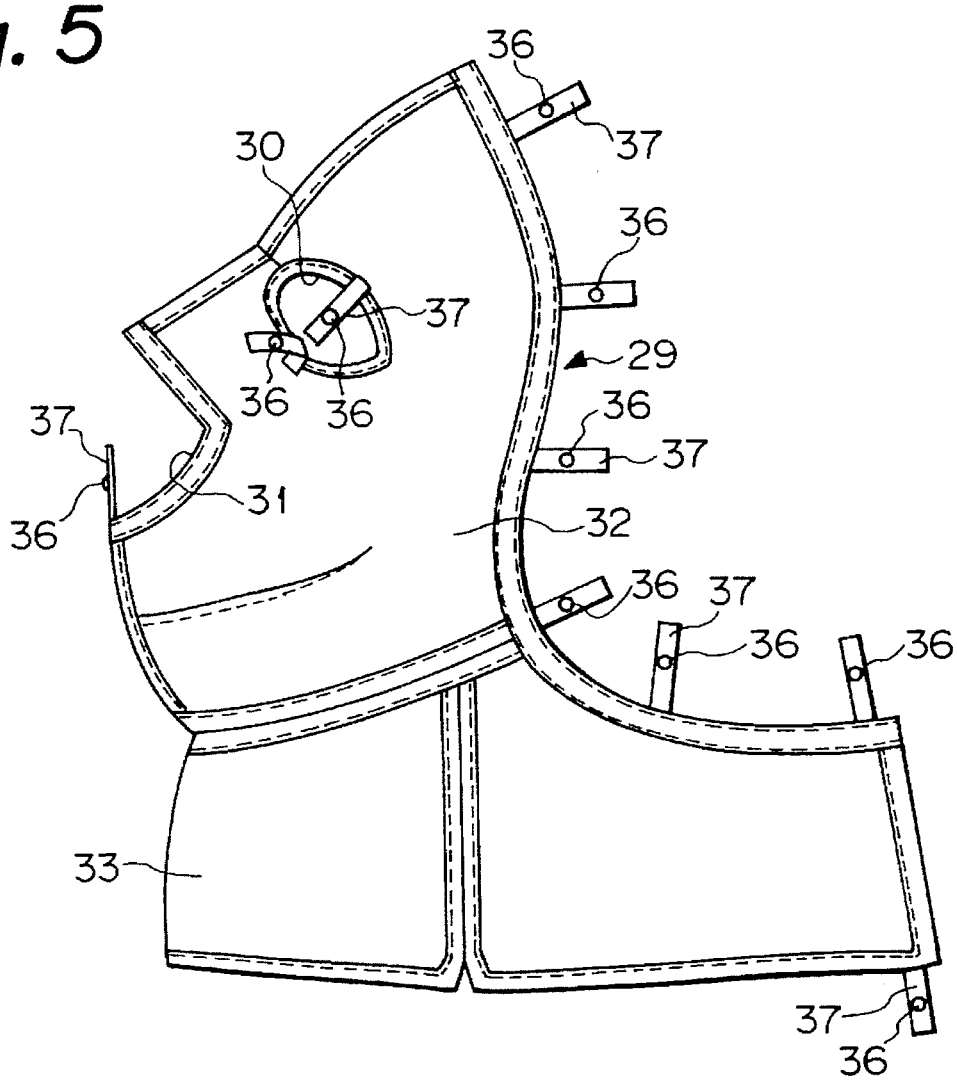
FIG. 5 is a side view of an inner mask in the first embodiment of the present invention as viewed from the left-hand side thereof.
Figure 6:
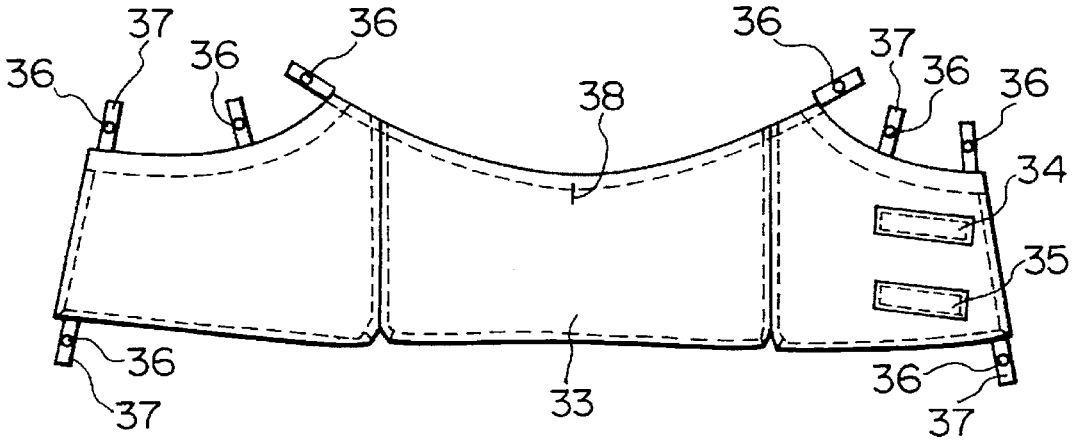
FIG. 6 is a rear view of a neck covering portion of the inner mask in the first embodiment of the present invention which is in an open state.
Figure 12:
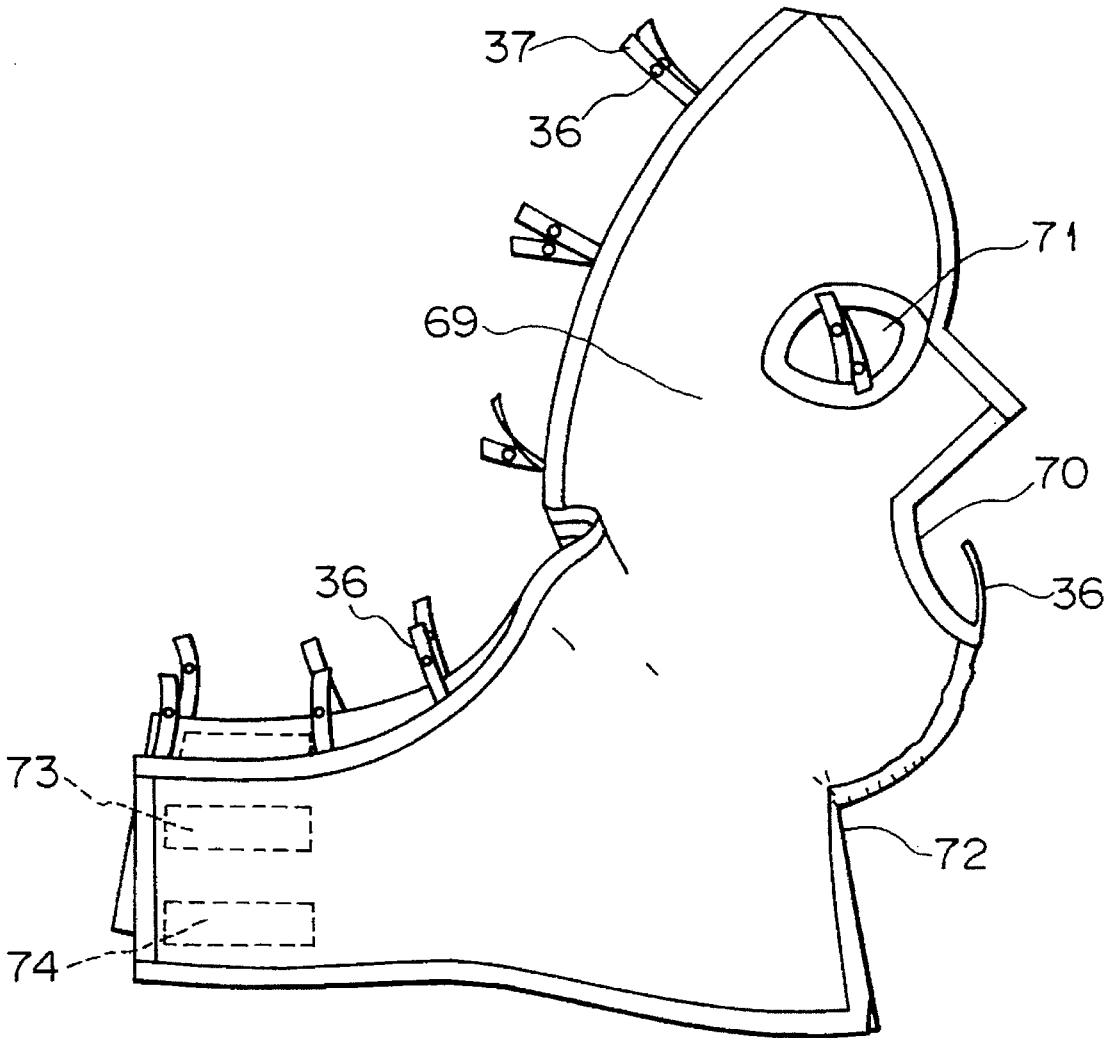
FIG. 12 is a side view of a modification of the inner mask in the present invention as viewed from the right-hand side thereof.

As shown in FIGS. 5 and 6, the inner mask 29 is composed of a face covering portion 32 which is three-dimensionally formed by sewing in conformity to the facial configuration and which is provided with openings 30 and 31 at respective positions corresponding to the eyes and the mouth, and a belt-shaped neck covering portion 33 which is integrally sewn to the lower edge of the face covering portion 32. It should be noted that the inner mask 29 may be modified as shown in FIG. 12. In the modification, the inner mask 69 has face and neck covering portions formed by cutting a single piece of cloth and is provided with openings 70 and 71 at respective positions corresponding to the eyes and the mouth.

Hook-and-Loop fastener 34 and 35 are attached to the reverse side of one end portion of the neck covering portion 33. In the modification shown in FIG. 12, Hook-and-Loop fastener 73 and 74 are similarly attached to the reverse side of the inner mask 69, which has face and neck covering portions formed by cutting a single piece of cloth. Male hooks 36 are attached to the peripheral edges of the face and neck covering portions 32 and 33 and to the edges of the eye and mouth openings 30 and 31 of the face covering portion 32 through respective narrow strips 37. In the modification, male hooks 36 are also attached to the peripheral edge of the inner mask 69 and to the peripheral edges of the eye and mouth openings 70 and 71 through respective narrow strips 37. By fitting the male hooks 36 into the female hooks 24, respectively, of the outer mask 2, the outer and inner masks 2 and 29 (2 and 69) are joined together and maintained in the joined state.

An elastic cord outlet opening 38 is provided in the upper end of the center of the neck covering portion 33 to draw out the central portion of the elastic cord 26 of the outer mask 2. By pulling out the central portion of the elastic cord 26 through the opening 38, the outer and inner masks 2 and 29 are tied together at their central portions through the elastic cord 26 and thus brought into close contact with each other. In addition, the outer and inner masks 2 and 29 are prevented from being displaced relative to each other. The same is the case with the modification composed of the outer mask 2 and the inner mask 69.

As shown in FIG. 8, tapes 39 and 40 are crossed in an X shape. One end of each of the tapes 39 and 40 is provided with a hook member 41 (42) which is to be engaged with one of the ring-shaped engagement portions 15 provided on the face covering portion 5 of the outer mask 2. The other ends of the tapes 39 and 40 are provided with Hook-and-Loop fasteners 43 and 44 which are to be stuck to the Hook-and-Loop fasteners 18 and 19 attached to the neck covering portion 6 of the outer mask 2. The tapes 39 and 40 enable the mask body 1 to be stably held in a desired position with respect to the vertical direction.

As shown in FIG. 9, a tape 45 is provided at one end thereof with a hook member 46 for engagement with the ring-shaped engagement portion 16 provided on the face covering portion 5 of the outer mask 2. The other end of the tape 45 is provided with a Hook-and-Loop fastener 47 which is to be stuck to the Hook-and-Loop fastener 17 attached to the face covering portion 5 of the outer mask 2. The tape 45 enables the mask body 1 to be stably held in a desired position with respect to the horizontal direction.

Figure 10:
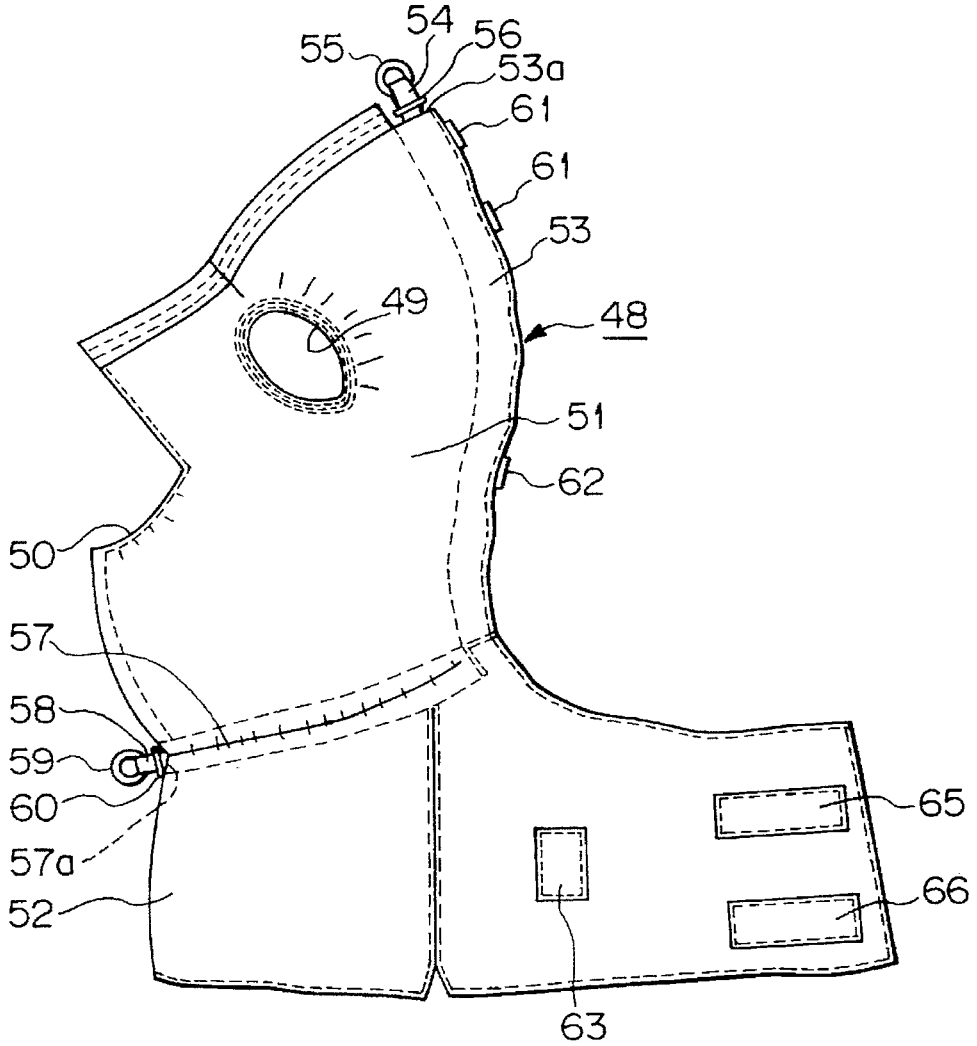
FIG. 10 is a side view of a mask body in a second embodiment of the present invention as viewed from the left-hand side thereof.
Figure 11:
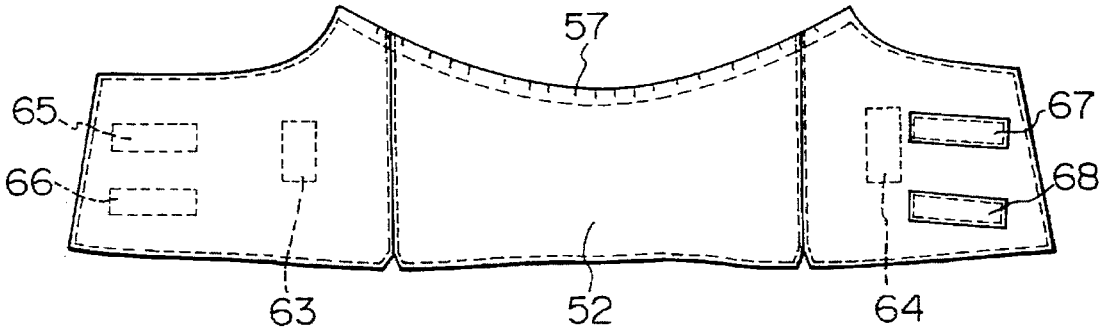
FIG. 11 is a rear view of a neck covering portion of the mask body in the second embodiment of the present invention which is in an open state.

Next, a second embodiment of the present invention will be explained with reference to FIGS. 10 and 11.

A mask body 48 has a face covering portion 51 and a neck covering portion 52, which will be explained later in detail. The face and neck covering portions 51 and 52 are each made of a double-layered material composed of a material excellent in heat retaining properties and hygroscopicity, e.g., wool knit, and another material that has excellent air permeability and hygroscopicity, e.g., cotton knit. These two different kinds of material are laid one on top of the other and sewn together inseparably so that the latter material, which is excellent in air permeability and hygroscopicity, constitutes the inner side of the mask body 48.

The mask body 48 has an arrangement similar to that of the mask body 1 in the first embodiment. That is, the mask body 48 is composed of a face covering portion 51 which is three-dimensionally formed by sewing in conformity to the facial configuration and which is provided with openings 49 and 50 at respective positions corresponding to the eyes and the mouth, and a belt-shaped neck covering portion 52 which is integrally sewn to the lower edge of the face covering portion 51.

In addition, the mask body 48 has a tubular elastic cord inserting portion 53 provided along the peripheral edge thereof except along the lower end of the face covering portion 51. The elastic cord inserting portion 53 has an opening **53*a* provided at the top of the face covering portion 51. A fastening elastic cord 54 is folded into two, and the two halves of the folded elastic cord 54 are inserted into the left and right halves, respectively, of the tubular elastic cord inserting portion 53. The ends of the two halves of the elastic cord 54 inserted are connected to the inner ends, respectively, of the tubular elastic cord inserting portion 53. The central portion of the fastening elastic cord 54 is left projecting from the opening 53*a* and provided with a ring 55 and a fitting member 56 for adjusting the fastening condition of the elastic cord 54**.

The mask body 48 further has a tubular elastic cord inserting portion 57 provided along the upper edge of the neck covering portion 52. The tubular elastic cord inserting portion 57 has an opening **57*a* at the chin of the face covering portion 51. A fastening elastic cord 58 is folded into two, and the two halves of the folded elastic cord 58 are inserted into the left and right halves, respectively, of the tubular elastic cord inserting portion 57. The ends of the two halves of the elastic cord 58 inserted are connected to the inner ends, respectively, of the elastic cord inserting portion 57. The central portion of the fastening elastic cord 58 is left projecting from the opening 57*a* and provided with a ring 59 and a fitting member 60 for adjusting the fastening condition of the elastic cord 58**.

Ring-shaped engagement portions 61 and 62 are provided on the face covering portion 51 of the mask body 48. Hook-and-Loop fasteners 63 and 64 are attached to the neck covering portion 52 of the mask body 48 at respective positions closer to the nape of the neck. Hook-and-Loop fasteners 65, 66, 67 and 68 are attached to the neck covering portion 52 of the mask body 48 such that the Hook-and-Loop fasteners 65 and 66 are disposed on the obverse side of the left end portion of the neck covering portion 52, while the Hook-and-Loop fasteners 67 and 68 are disposed on the reverse side of the right end portion of the neck covering portion 52. It should be noted that illustration of a Hook-and-Loop fastener attached to the outer side of one side of the face covering portion 51 is omitted.

It should be noted that, in this embodiment also, the tapes 39, 40 and 45 are used to wear the mask body 48 in the same way as in the first embodiment, and that illustration thereof is herein omitted. The mask body 48 in this embodiment may be arranged such that an inner mask, which may be similar to the inner mask 29 in the first embodiment or the inner mask 69 in the modification, is added to the inner side of the mask body 48, although such an alternative arrangement is not shown in the drawings.

With the above-described arrangement and function, the present invention provides the following advantages:

If the user is wearing the moisture retaining face mask while he or she is asleep, the skin can be surely prevented from cooling and drying at night. Moreover, the moisture retaining face mask can be readily attached and detached without any troublesome procedure.

If the user wears the moisture retaining face mask according to the present invention with oil-based cream put on his/her face, neck and nape washed before going to bed, the oil component penetrates into the horny layer of the skin by skin respiration taking place while the user is asleep, thereby making it possible to obtain a freshly moist and flexible skin of high transparency.

Further, the moisture retaining face mask prevents aging of the skin to thereby prevent it from becoming rough, and hence enables cosmetics to be favorably and effectively put on the skin. Accordingly, it is possible to make the best use of the effect of the present high quality cosmetics.

In a case where the mask body is composed of an outer mask and an inner mask, which are separable from each other, the thickness of the mask body can be varied according to the change of atmospheric temperature. That is, when the user feels very cold, the outer and inner masks are joined together, whereas, when he or she does not feel very cold, only the outer mask is used with the inner mask detached therefrom. It is desirable to wash the mask frequently because it is readily stained. In this regard, since the outer and inner masks are separable, only the inner mask, which comes in direct contact with the skin, need be washed. Therefore, the moisture retaining face mask of the present invention is extremely convenient and favorable from an hygienic point of view. In cold districts or during cold seasons, the user can keep his/her face warm with the moisture retaining face mask and can, therefore, sleep comfortably.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A moisture retaining face mask comprising:

a mask body including an outer mask made of a material that is air permeable, hygroscopic and heat retentive, and an inner mask made of a material that is hygroscopic, said inner mask being in close contact with a reverse side of said outer mask and separably joined thereto, said outer mask including a face covering portion which is sewn in conformity to a facial configuration and which is provided with openings at respective positions corresponding to a user's eyes and mouth, and a neck covering portion having first and second end portions and which is connected to a lower edge of said face covering portion, said outer mask further having a first elastic cord housing portion provided along a peripheral edge of said outer mask except along a lower peripheral edge of said face covering portion, said elastic cord housing portion having an opening at a top portion of said face covering portion, said outer mask further having a first fastening elastic cord inserted into said first elastic cord housing portion through said opening and fixed at both ends thereof in said first elastic cord housing portion, said outer mask further having a second elastic cord housing portion provided along said lower edge of said face covering portion, said second elastic cord housing portion having an opening at a central portion of said second elastic cord housing portion, said outer mask further having a second fastening elastic cord inserted into said second elastic cord housing portion through said opening and fixed at both ends thereof in said elastic cord housing portion, said outer mask further having a third elastic cord housing portion provided along an upper edge of a reverse side of said neck covering portion, said third elastic cord housing portion having an opening in a central portion of said third elastic cord housing portion, said outer mask further having a third fastening elastic cord inserted into said third elastic cord housing portion and partially drawn out from said opening provided in said central portion of said third elastic cord housing portion, said inner mask including a face covering portion which is sewn in conformity to a facial configuration and which is provided with openings at respective positions corresponding to a user's eyes and mouth, and a neck covering portion which is connected to a lower edge of said face covering portion, said inner mask having an elastic cord outlet opening in an upper edge of a central portion of said neck covering portion thereof for drawing out a part of said third fastening elastic cord of said outer mask, said outer mask further having a hook-and-loop fastener fixed to an obverse side at one of a left side and a right side of said face covering portion, and hook-and-loop fasteners fixed to an outer side of said neck covering portion at respective positions which correspond to the nape of a user's neck, said outer mask further having joint securing hook-and-loop fasteners fixed to said neck covering portion such that one of said hook-and-loop fasteners is disposed on an obverse side of one of said first and second end portions of said neck covering portion, and the other hook-and-loop fastener is disposed on a reverse side of the other of said first and second end portions, and said inner mask having a joint securing hook-and-loop fastener fixed to a reverse side of one end portion thereof;

a pair of tapes crossed in an X shape, one end of each tape being connectable to said top portion of said face covering portion of said outer mask, said pair of tapes having hook-and-loop fasteners respectively fixed to the other ends of each said tape so that said hook-and-loop fasteners fixed to said tape ends can be attached to said respective hook-and-loop fasteners which are fixed to said neck covering portion of said outer mask at said positions corresponding to the nape of a user's neck; and another tape connectable at one end thereof to the other of said left and right sides of said face covering portion of said outer mask, said tape having a hook-and-loop fastener fixed to the other end of said tape so that said hook-and-loop fastener can be attached to said hook-and-loop fastener fixed to said one of said left and right sides of said face covering portion of said outer mask.

2. A moisture retaining face mask as claimed in claim 1, wherein said outer mask is hand knitted, machine knitted, or sewn.

3. The moisture retaining face mask as claimed in claim 1, wherein said neck covering portion of said outer mask is belt shaped and is integrally sewn to said lower edge of said face covering portion.

4. A moisture retaining face mask comprising:

a mask body including a face covering portion sewn in conformity to a facial configuration and provided with openings at respective positions corresponding to a user's eyes and mouth, and a neck covering portion having first and second end portions and which is connected to a lower edge of said face covering portion, said face and neck covering portions being made of a double-layered material composed of a first material that is heat retentive and hygroscopic and a second material that is air permeable and hygroscopic, said first and second materials being laid one on top of the other and sewn together so that said second material constitutes an inner side of said mask body, said mask body having a first elastic cord housing portion provided along a peripheral edge of said mask body except along a lower peripheral edge of said face covering portion, said elastic cord housing portion having an opening at a top portion of said face covering portion, said mask body further having a first fastening elastic cord inserted into said first elastic cord housing portion through said opening and fixed at both ends thereof in said first elastic cord housing portion, said mask body further having a second elastic cord housing portion provided along an upper edge of said neck covering portion, said second elastic cord housing portion having an opening at a central portion of said second elastic cord housing portion, said mask body further having a second fastening elastic cord inserted into said second elastic cord housing portion through said opening and fixed at both ends thereof in said elastic cord housing portion, said mask body having a hook-and-loop fastener fixed to an obverse side at one of a left side or a right side of said face covering portion, and hook-and-loop fasteners fixed to an outer side of said neck covering portion at respective positions which correspond to the nape of a user's neck, said mask body further having joint securing hook-and-loop fasteners fixed to said neck covering portion such that one of said hook-and-loop fasteners is disposed on an obverse side at one of said first and second end portions of said neck covering portion, and the other hook-and-loop fastener is disposed on the reverse side of the other of said first and second end portions;

a pair of tapes crossed in an X shape, one end of each tape being connectable to said top portion of said face covering portion, said pair of tapes having hook-and-loop fasteners respectively fixed to the other ends of said tapes so that said hook-and-loop fasteners fixed to said tape ends can be attached to said respective hook-and-loop fasteners which are fixed to said neck covering portion at said positions corresponding to the nape of a user's neck; and another tape connectable at one end thereof to the other of said left and right sides of said face covering portion, said tape having a hook-and-loop fastener fixed to the other end of said tape so that said hook-and-loop fastener can be attached to said hook-and-loop fastener fixed to said one of said left and right sides of said face covering portion.

5. A moisture retaining face mask as claimed in claim 4, wherein said face covering portion and said neck covering portion comprise a single piece of cloth cut into a pair of left and right halves with openings provided therein at respective positions corresponding to a user's eyes and mouth, and said left and right halves being sewn together along a center line of said face covering portion so that the resulting mask body is conformable to a facial configuration.

6. A moisture retaining face mask as claimed in claim 4, wherein said mask body is produced by hand knitting, machine knitting, or sewing.

7. The moisture retaining face mask as claimed in claim 4, wherein said neck covering portion is belt shaped and is integrally sewn to said lower edge of said face covering portion.

* * * * *